US010022792B2

(12) United States Patent
Srivas et al.

(10) Patent No.: US 10,022,792 B2
(45) Date of Patent: Jul. 17, 2018

(54) PROCESS OF DOUGH FORMING OF POLYMER-METAL BLEND SUITABLE FOR SHAPE FORMING

(71) Applicant: The Indian Institute of Technology, Kharagpur, West Bengal, Kharagpur (IN)

(72) Inventors: Pavan Kumar Srivas, West Bengal (IN); Kausik Kapat, West Bengal (IN); Santanu Dhara, West Bengal (IN)

(73) Assignee: The Indian Institute of Technology, Kharagpur, West Bengal (IN)

( * ) Notice: Subject to any disclaimer, the term of this patent is extended or adjusted under 35 U.S.C. 154(b) by 334 days.

(21) Appl. No.: 14/939,605

(22) Filed: Nov. 12, 2015

(65) Prior Publication Data

US 2016/0136728 A1 May 19, 2016

(30) Foreign Application Priority Data

Nov. 13, 2014 (IN) ..... 1173/KOL/2014

(51) Int. Cl.
*B22F 1/00* (2006.01)

(52) U.S. Cl.
CPC ..... *B22F 1/0074* (2013.01); *B22F 1/0096* (2013.01); *B22F 2001/0066* (2013.01); *B22F 2998/10* (2013.01)

(58) Field of Classification Search
CPC ... B22F 1/0074; B22F 1/0096; B22F 2202/00
USPC ..... 419/2, 32
See application file for complete search history.

(56) References Cited

U.S. PATENT DOCUMENTS

| | | | | |
|---|---|---|---|---|
| 2,033,240 | A | 3/1936 | Hardy | |
| 2,939,199 | A | 6/1960 | Strivens | |
| 4,197,118 | A | 4/1980 | Wiech, Jr. | |
| 4,415,528 | A | 11/1983 | Wiech, Jr. | |
| 5,745,834 | A | 4/1998 | Bampton | |
| 6,045,748 | A | 4/2000 | Hayashi | |
| 6,605,648 | B1 * | 8/2003 | Johnson | B22F 3/1121 264/126 |
| 7,491,356 | B2 | 2/2009 | Heikkila | |
| 2010/0092790 | A1 | 4/2010 | Luo | |

OTHER PUBLICATIONS

S. Shivkumar, L. Wang, and D. Apelian, "Molten Metal Processing of Advanced Cast Aluminum Alloys," JOM, 43 (1) (1991), pp. 26-32.

(Continued)

*Primary Examiner* — Mark A Chapman
(74) *Attorney, Agent, or Firm* — D'Ambrosio & Menon, PLLC; Usha Menon

(57) ABSTRACT

Processing of polymer-metal blend composition involving viscosity control under ambient conditions suitable for shape forming and homogeneous green body preparation. The advancement involves effective controlling of the rate of settling of the metal particles in polymer-metal blend under ambient conditions to generate a cost effective and simple process for producing shape formable dough. Advantageously, the present invention provides a rapid, energy saving process involving minimum material loss and utilizing non hazardous solvent system such as water.

15 Claims, 7 Drawing Sheets

(56) References Cited

OTHER PUBLICATIONS

T. Masuzawa, H.K. Tonshoff, Three-dimensional micromachining by machine tools, Annals of the CIRP 46 (1997) 621-628.
Masuzawa, T. (2000). "State of the art of micro machining." Annals of the CIRP, 49(2) pp. 473-488.
D. Dornfeld, S. Min, and Y. Takeuchi, "Recent advances in mechanical micromachining," CIRP Annals: Manufacturing Technology, vol. 55, No. 2, pp. 745-768, 2006.
R. Govindarajan, N. Aravas. "Deformation processing of metal powders: Part I—Cold isostatic pressing". In: International Journal of Mechanical Sciences 36.4 (1994), S. 343-357.
German, R.M. 1990. Powder Injection Molding, Metal Powder Industries Federation, Princeton, NJ.
Sundberg et al., "Rectifying metal-polymer contacts formed by melt processing;" Applied physics letters 57.7; 1990.
Kennedy, A R, Lin, X, 2011. Preparation and characterisation of metal powder slurries for use as precursors for metal foams made by gel casting Powder Metallurgy, 54,3, 376-381.
Sepulveda P. 1997. Gelcasting foams for porous ceramics. Am Ceram Soc Bull, 76, 61-65.
Andersen O, Waag U, Schneider L, Stephani G, Kieback B. 2000. Novel metallic hollow sphere structures, Advanced Engineering Materials, 2,192.
Angel S, Bleck W, Scholz PF, Fend T. 2004. Influence of powder morphology and chemical composition on metallic foams produced by Slip Reaction Foam Sintering (SRFS)-process. Steel Res Intl, 75, 483-488.
Shimizu T, Matsuzaki K. 2007. Metal foam production process using hydro-gel and its improvement. Mater Sci Forum, (539-543): 1845-1850.

* cited by examiner

Scheme 1: Coagulation dough processing

Scheme 2: Plastic dough processing

A B

PROCESS OF DOUGH FORMING OF POLYMER-METAL BLEND SUITABLE FOR SHAPE FORMING

PRIORITY CLAIM

This application is related to and claims priority to Indian Patent Application No. 1173/KOL/2014 filed on Nov. 13, 2014, the contents of which are incorporated by reference herein.

FIELD OF THE INVENTION

The present invention relates to dough processing of polymer-metal blend compositions. More specifically, the present invention is directed to processing of polymer-metal blend compositions suitable for shape forming by way of effective controlling the rate of settling of the metal particles in polymer-metal blend under ambient conditions to generate a cost effective and simple process for producing shape formable dough. Advantageously, the present invention provides a rapid, energy saving process involving minimum material loss and utilizing non hazardous solvent system such as water. In addition to this the process of the invention and polymer-metal blend products obtained thereof are suitable for working involving wide range of polymers.

BACKGROUND OF THE INVENTION

Casting and moulding are the conventional and widely practised bottom-up approach which involved melting the metal and moulding (Shivkumar et al., JOM 43.1, 1991: 26-32). Machining of metal blocks by cutting and drilling to fabricate desired shape is also practised conventionally but is not cost effective (Masuzawa et al., CIRP Annals-Manufacturing Technology 46.2 (1997): 621-628, 49.2 (2000): 473-488; Dornfeld et al., CIRP Annals-Manufacturing Technology 55.2 (2006): 745-768). Loose sintering is the simplest form of metal powder processing which can only produce porous parts and takes longer time for sintering without compaction, while isostatic pressing can produce relatively large parts of high aspect ratio with superior material properties Govindarajan et al., International journal of mechanical sciences 36.4 (1994): 343-357). High-end equipments are necessary for pressing at a very high pressure as well as extremely high temperature that are truly expensive. In roll compaction or powder rolling, metal powder is pressed between two heavy duty pressure rollers that rotate to form a continuous length of metal strip or sheet; however, does not have the versatility to produce any other shape (U.S. Pat. No. 2,033,240, 1936)). Complex solid metallic parts with intricate geometries and thin walls are mostly made through metal injection moulding (MIM) (German et al., MPIF, Princeton, N.J. (1990); Sundberg et al., Applied physics letters 57.7 (1990): 733-734.; Adv.; Johnson et al., Mater. Processes, 161 (4) (2003), pp. 35-39). Major drawback of such a process is very high volume of shrinkage during sintering owing to relatively high binder content and densification by removal of high porosity. In MIM molding the process is limited only to the thermoplastic polymer matrix which again involves temperature for processing. Spark plasma sintering (SPS) is a unique powder processing technique for producing high quality objects in a single step without use of any binder. Metal powder is sintered under pulsed DC current in sparking condition. However, SPS is only limited to produce simple symmetrical shapes and makes use of expensive pulsed DC generator.

The metal powders are difficult to disperse using only electrosteric stabilization owing to their high density, low charge density (thin oxide coating) and bigger particle size. Most of the existing processes involve viscosity change from a low viscosity to high viscous slurry after casting followed by drying and sintering (Sepulveda, 1997; Andersen et al., 2000; Angel et al., 2004; (Shimizu and Matsuzaki, 2007; Kennedy and Lin, 2011). Thickener is reported to be used as a stabilizer/viscosity-enhancer for uniform metal suspension. After casting, no further modification can be done to the formed shapes. In such process no reprocessing can also be done after that, if required.

Recently, metallic parts are also known to be fabricated by 3D printing/rapid prototyping, as an alternative to casting and machining. These techniques are useful for development of objects from computer aided design (CAD) model through layer-by-layer fabrication. However all these techniques are based on melting and deposition of metal powder or thermoplastic polymer as binder. Fugitive based techniques were commonly used for last two decades to generate highly open porous structures. Process like slurry based casting or 3D printing are limited by high drying time, surface contamination due to oxide formation during processing and significant carbon residue after sintering which makes them brittle.

Several prior U.S. Pat. No. 6,045,748, U.S. Pat. No. 7,491,356, US20100092790, U.S. Pat. No. 5,745,834, U.S. Pat. No. 4,197,118 relate to processes of manufacturing articles of metal powder from particulate material and a polymer/binder though various process steps all of which include steps of heating, melting, cooling, drying, and providing a green body before sintering.

U.S. Pat. No. 4,415,528 relates to the method of forming metal alloy shaped parts from a mix of metals and/or individual compounds along with a binder to form a homogeneous mass which form green bodies. The green bodies are then processed by stripping of the binder and raising the temperature of the stripped body below the sintering temperature of the metals and finally sintering was done.

U.S. Pat. No. 2,939,199 relates to process of manufacturing articles from sinterable materials ceramic powders, metal carbides, or their mixtures, by mixing them with a vehicle comprising a thermosetting moulding material and a plasticizer. Moulding results in green shape which is hardened.

However in the above mentioned prior arts, usually most of the process steps are complex and the difficulty in making homogeneous distribution of metal particles in slurry based casting techniques since settling of the particles persists. Hence there remains a continuing need in the art to develop a simple dough processing technique which would have the ability to produce both dense and porous shape formable dough for desired metal objects in a cost-effective way. Further, the process should offer fabrication of diverse size and shape of the components with tailorable microstructure within a reasonable time frame.

SUMMARY OF THE INVENTION

It is thus the basic object of the present invention to provide the process for rapid processing of homogeneous dough of polymer-metal blend composition ranging from dense, porous, dense-porous gradient.

Another object of the present invention is to provide the processing for polymer-metal blend composition with tailorable porous structures with controlled porosity and pore size distribution.

Another object of the present invention is directed to the energy efficient simple process of processing polymer-metal blend composition by converting low viscous polymer-metal blend solution into high viscous dough under ambient conditions to generate shape formable dough with involvement of less quantity of non-toxic, aqueous/non-aqueous solvents, controlling the viscosity.

Another object of the present invention is to provide the processing for polymer-metal blend composition for formation of alloy in one step during sintering.

A further object of the invention is related to the fabrication of different metallic shapes like tapes, rods, tubes, springs, domes, sheets, laminated objects, biomedical implants along with miniaturized patterns/features like microrod arrays through embossing or micro-patterning etc. involving a common platform technology.

Another object of the present invention relates to metallic products with easy machinability in green state via tooling/laser ablation/extrusion/embossing etc. for large scale productions for diverse end uses and applications.

Another object of the present invention relates to development of dough with the much lower yield stress as compared to the metal used for processing, thus making the process of generating metallic body production involving such dough more energy efficient.

Yet another object of the present invention is related to metal foam with high permeability, high thermal conductivities (5-30 W/mK), resistance to thermal shocks, high pressures, high temperatures, moisture, wear and thermal cycling, good absorption of mechanical shock and sound, suitable for wide applications in design/architectural, automobile, biomedical etc.

Thus, according to the basic aspect of the present invention there is provided a process of dough forming of polymer-metal blend compositions suitable for shape forming comprising:

controlling the rate of settling of the metal particles in polymer-metal blend by converting a low viscous polymer-metal blend composition into high viscous dough under ambient conditions to generate shape formable dough; and subjecting the dough to shape forming into desired metallic bodies.

Another aspect of the present invention provides a process wherein said step of controlling the rate of settling of the metal particles in polymer-metal blend dispersion by converting a low viscous polymer-metal blend dispersion into high viscous dough under ambient conditions to generate shape formable dough includes coagulation dough processing (CDP) involving coagulant with or without foaming agents or fugitives.

In another aspect, the present invention provides a process involving dense shape formable dough comprising coagulation dough processing involving coagulant and free of any foaming agents or fugitives:

i) providing metal powder dispersion in polymeric solution;

ii) increasing the viscosity of said metal powder dispersion in polymer solution involving said coagulant with or without other additives to thereby provide for said dense shape formable dough via high shear mixing with pressure ranging from 1 to 500 MPa preferably up to 100 MPa;

iii) subjecting the thus obtained dense shape formable dough to shape forming, drying and sintering.

In another aspect, the present invention provides a process comprising:

i) mixing metal powder, polymer powder, glycerol, solvents under stirring for a period of 10-30 minutes depending upon the volume;

ii) adding coagulants under stirring, subsequently subjected to mixing for 2-3 hrs till a smooth lustre appears to the dough which facilitates removal of entrapped air bubbles and intimate mixing of all the ingredients under high shear with pressure ranging from 1 to 500 MPa preferably up to 100 MPa;

iii) after mixing, the dough was subjected to shaping through plastic deformation/yielding above the yield stress of the prepared dough;

iv) the dried green body was further subjected to heat treatment including sintering to obtain final dense components;

optionally, grinding, polishing or any other shaping/finishing may be done, if required.

A further aspect of the present invention provides a process wherein said mixing is carried out selectively involving anyone or more of roll mill, mechanical stirring/sigma blender/cone blender/V-blender for bulk volumes and after mixing, the dough was subjected to shaping through plastic deformation/yielding above the yield stress of the prepared dough, and finally the dried green body was further subjected to heat treatment (sintering) to obtain final dense components and optionally involving grinding, polishing or any other shaping/finishing Another aspect of the present invention relates to a process wherein the polymer-blend composition (wt %) comprises based on the weight of metal powder:

| | |
|---|---|
| A) Polymer powder | 1-50 |
| B) Solvent | 3-30 |
| C) Lubricants | 0.1-10 |
| D) Plasticizers | 0.1-10 |
| E) Coagulant | 0.1-10 |
| F) Other additives | 0.1-10 |

In a further aspect the present invention relates to a process involving porous shape formable dough comprising:

i) providing metal powder dispersion in polymeric solution;

ii) increasing the viscosity of said metal powder dispersion in polymer solution involving said coagulant to thereby shape formable dough by high shear mixing in presence of fugitive/foaming agent;

iii) subjecting the thus obtained porous shape formable dough to shape forming, drying and sintering.

In yet another aspect, the present invention provides a process involving porous shape formable dough comprising:

i) providing polymeric solution and coagulant with or without other additives to provide a polymer-coagulant composition;

ii) subjecting said polymer-coagulant composition to vigorous stirring to increase viscosity by frothing; and iii) thereafter gradually adding the metal powder to said mix of step ii) above to thereby further increase of viscosity of said metal powder dispersion in polymer solution and generate a porous shape formable dough;

iv) subjecting the thus obtained porous shape formable dough to cast into a predefined lubricated mold for shape forming without further high shear mixing, and drying.

v) dried green body was further subjected to heat treatment (sintering) to obtain final porous components.

In another aspect, the present invention relates to a process wherein addition of foaming agents and/or fugitive particles for porosity or increasing pore connectivity in said generated shape formable dough for porous structures, interconnected secondary macropores and wherein sintered density, total porosity, pore size distribution, microstructure, mechanical properties are selectively varied based on selective additives involved.

A further aspect of the present invention relates to a process wherein the polymer-blend composition (wt %) comprises based on the weight of the metal powder:

| | |
|---|---|
| A) Polymer powder | 1-50 |
| B) Solvent | 3-30 |
| C) Lubricants | 0.1-10 |
| D) Plasticizers | 0.1-10 |
| E) Coagulant | 0.1-10 |
| F) Other additives | 0.1-10 |
| G) Fugitive/foaming agent | upto 15 |

Yet another aspect of the present invention relates to a process wherein said step of converting a low viscous polymer-metal blend composition into high viscous dough under ambient conditions to generate shape formable dough comprises plastic dough processing (PDP) involving high shear mixing of metal powder and polymer blend composition with or without fugitive/foaming agent under ambient conditions.

A further aspect of present invention relates to a process comprising:

i) providing metal powder;

ii) adding said metal powder to polymer with or without additives to obtain a polymer-metal blend composition;

iii) subjecting the said metal polymer-metal blend composition to high shear mixing to thereby generate shape formable plastic dough.

In another aspect, the present invention provides a process wherein said high shear mixing is carried out with pressure range of 1 to 500 MPa preferably up to 100 MPa at low temperature 4° C. to 40° C. preferably at 10° C. for de-agglomeration of polymers and metal powders and wherein the high shear promotes deformation, blending of metal powders within polymer matrix in presence of very low amount of solvent, co-solvent, plasticizer and surfactant along with the applied shear force eliminating possibility of entrapped air bubbles during formation of dense components.

In a further aspect, the present invention relates to a process wherein (a) for dense component dough forming composition by weight of metal powder comprises:

| | |
|---|---|
| A) Polymer Powder | 1-50 |
| B) Solvent | 3-30 |
| C) Lubricants | 0.1-10 |
| D) Plasticizers | 0.1-10 |

and (b) for porous components dough forming composition by weight of metal powder comprises:

| | |
|---|---|
| A) Polymer Powder | 1-50 |
| B) Solvent | 3-30 |
| C) Lubricants | 0.1-10 |
| D) Plasticizers | 0.1-10 |
| F) Fugitive/foaming agent | 1-15 |

Another aspect of the present invention provides a process wherein after the formation of the shape formable dough, the fugitive/foaming agents are removed by anyone or more of (i) formed dough is either heated at 100-600° C. for burning out of the organic/inorganic fugitive particles or (ii) dipping within a solvent for leaching out of the soluble polymer/inorganic salts which leaves spaces after removal and turned into foam after sintering.

A further aspect of the present invention relates to a process wherein said low viscous polymer-metal blend composition is converted into high viscous dough under ambient conditions to generate shape formable dough with the following specifications:

I) For coagulation dough processing:

Viscosity at shear rate 0.03 ($s^{-1}$): 0.0001 to 1 MPa·s

Yield stress (MPa): 0.0001-2

II) For plastic dough processing involving high shear mixing of metal powder and polymer blend composition:

Viscosity at shear rate 0.03 ($s^{-1}$): 2 to 100 MPa·s

Yield stress (MPa): 2-50

According to yet another aspect of the present invention it has been found that the advancement involving the polymer-metal blend working under ambient conditions for shape formable dough the involvement of high shear mixing except in case of dough forming involving foaming/air bubble entrapment involves a selective range of 1 to 500 MPa since it has been experimentally found that roll milling was not possible at <1 MPa, hence dough formation was not possible while attempts at above 500 MPA lead to polymer degradation which thus again affected desired shape formability of the dough.

Another aspect of the present invention provides a process wherein the dough obtained is selectively worked into dense and/or porous, graded or laminated objects with various shapes including rods, tubes, blocks, spring or other hollow structures along with required surface texturing for metal stent, drug eluting stent, device for lumen stricture, bone plates, bone screws, dental roots and crowns, dental bridges, spinal shunt, hip joints, knee joints and any other structural load bearing supports, metal foams for architectural, automobile, biomedical applications including cancellous bone analogue, dense-porous laminates and gradients for dental roots and bone.

BRIEF DESCRIPTION OF THE ACCOMPANYING FIGURES

Figure 5:
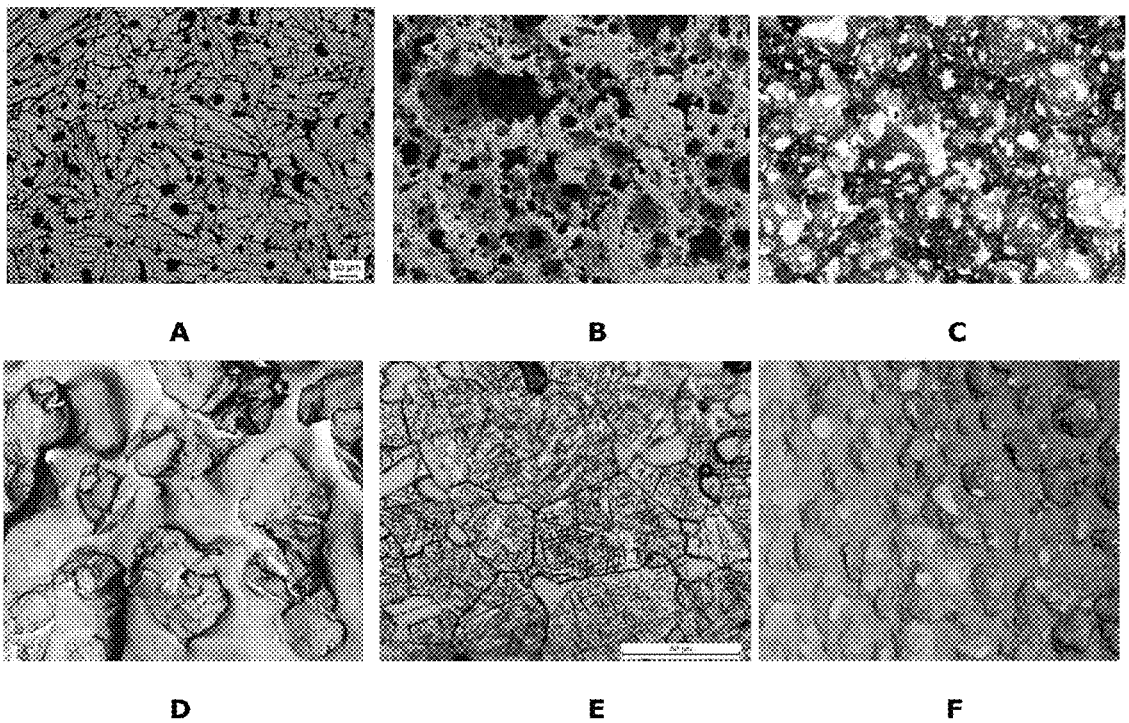

FIG. 5: 5A-C illustrate the microstructure by coagulation dough processing (CDP) (A) dense (B) porous without fugitives (C) porous with fugitives.

5D-F illustrate the microstructure by Plastic Dough processing (D-E) Dense (F) Porous with fugitives.

Figure 6:
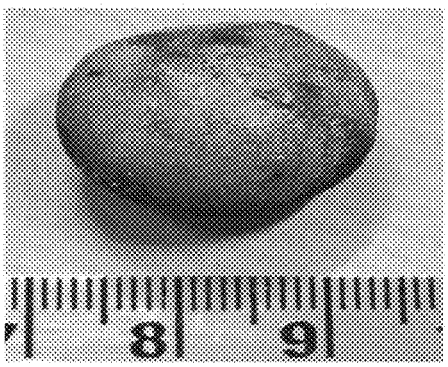

FIG. 6 illustrates the sintered dense component prepared by CDP.

Figure 7:
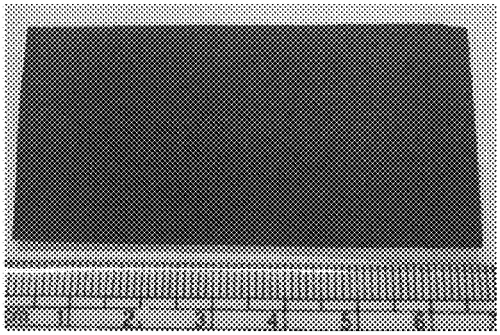

FIG. 7 represents Rolled PDP Ti6Al4V tape.

Figure 8:
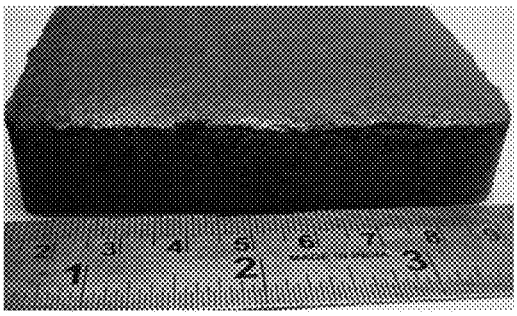

FIG. 8 illustrates the Green samples of Ti6Al4V foam developed by CDP.

Figure 9:
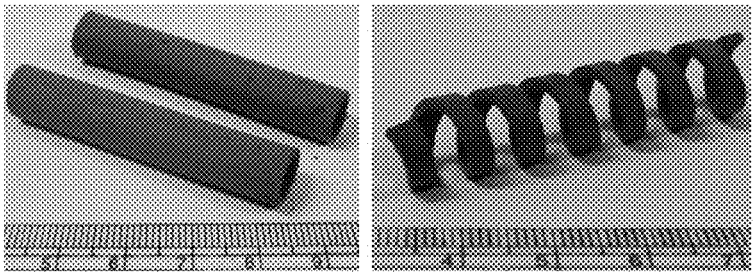

FIG. 9 represents the Tubes and spring through extrusion and laser machining.

Figure 10:
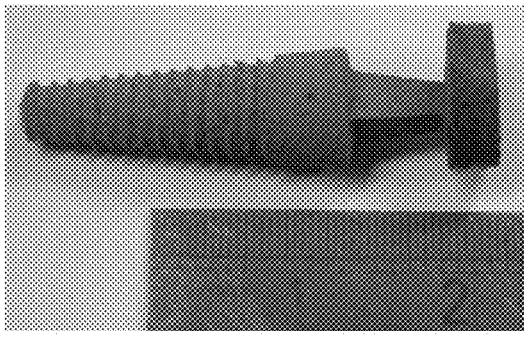

FIG. 10 represents the Dental root by CNC machining.

Figure 11:
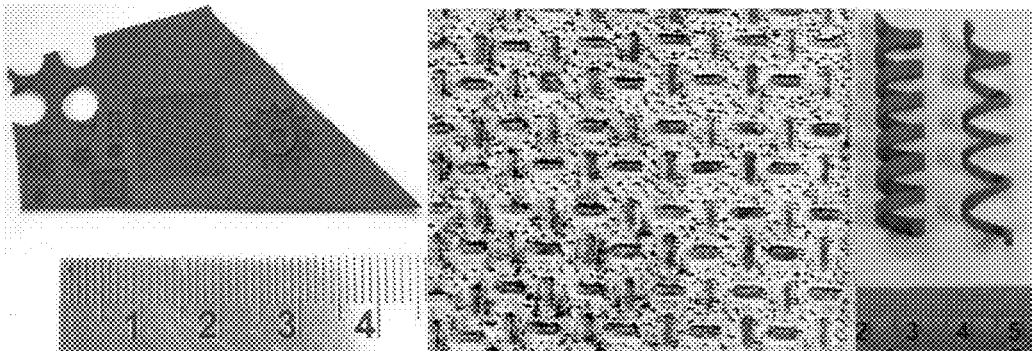

FIG. 11 represents Laser machined samples.

Figure 12:
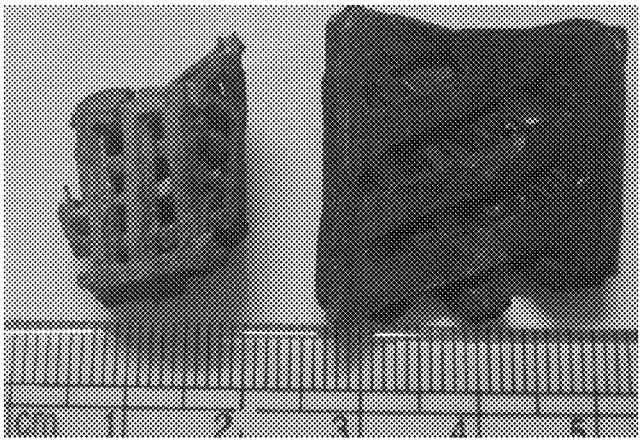

FIG. 12 represents Porous metallic sample via laser machining and lamination.

Figure 13:
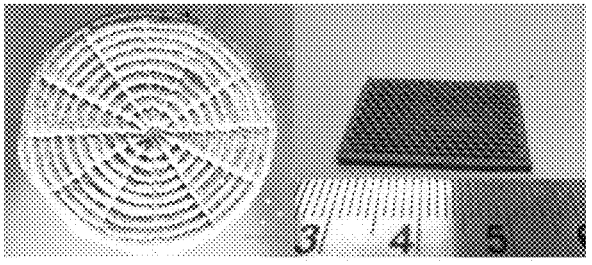

FIG. 13 represents Micro-patterned samples through embossing.

Figure 14:
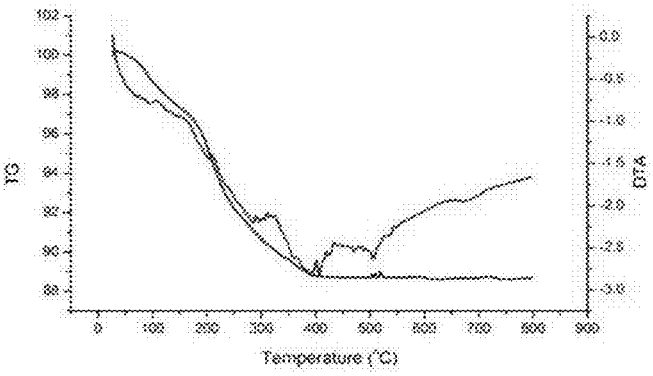

FIG. 14 represents TGA and DTA plot of Ti6Al4V/chitosan dough.

Figure 15:
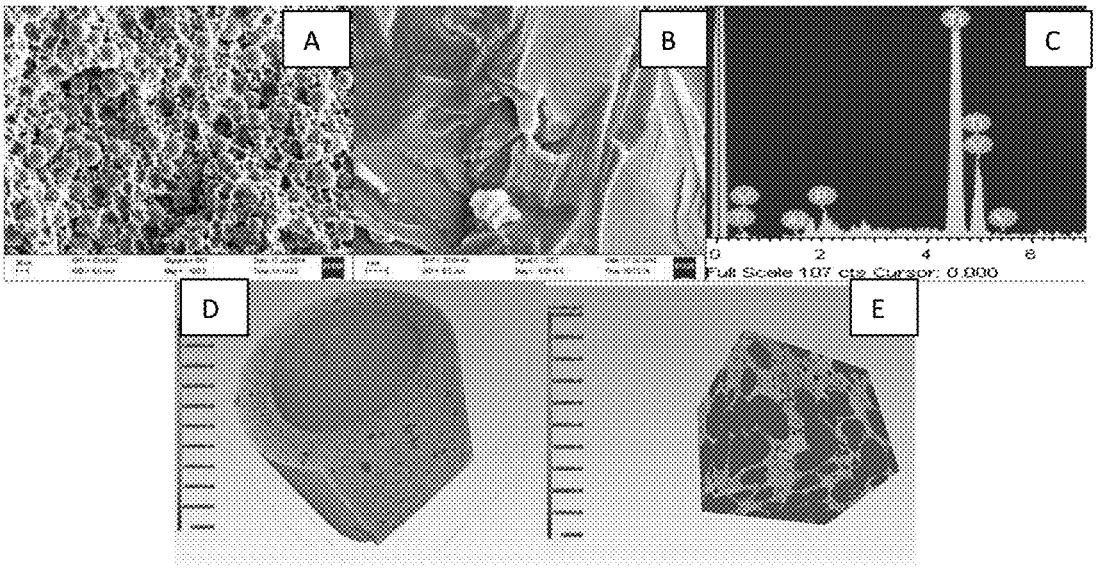

FIG. 15 represents SEM microstructures of Ti6AL4V/chitosan samples for (a) green and (b) sintered; (c) EDX of sintered sample; micro-CT images for (d) dense (e) porous.

Figure 16:
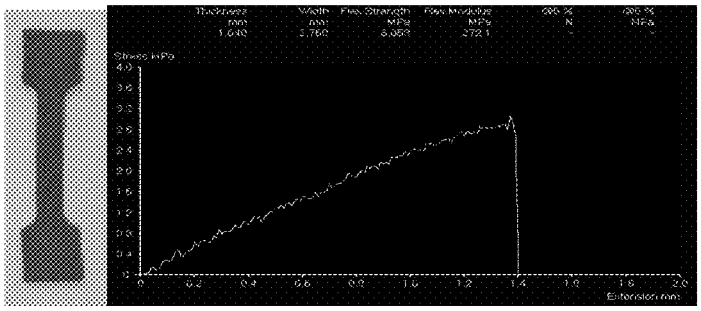

FIG. 16 represents (a) Sample for mechanical testing prepared as per ASTM standard (b) results of 3-point bending test for green strength.

DETAILED DESCRIPTION OF THE INVENTION

The invention thus provides method for dough forming of polymer-metal blend composition with controlled rate of settling of metal particles which would provide for highly loaded particles with minimum powder settling leading to homogeneous green body preparation involving low energy consumption and though cost effective and use friendly route. As discussed hereinbefore the present advancement enables the following manners of preparing high viscous slurry/dough.

Method 1 (Scheme 1): Formation of viscous dough from flowable metal-polymer loaded slurry using organic/inorganic additives as coagulant for dense and/porous body (CDP).

Method 2 (Scheme 2): Formation of viscous dough from blends of polymer(s) powder, metal powder, minimum solvent, additives through high shear mixing for dense and/porous body (PDP).

The present invention by way of the present advancements and following any of the above methods enables converting low viscous slurry to a high viscous dough under ambient conditions thus favouring a cost effective and energy efficient process of metallic body forming. Processing in the present invention involves achieving high viscous dough for shape formation either mixing under high shear force or by influence of coagulant with or without foaming with characteristic viscosity ranges to make the dough flowable/castable/mouldable above yield stress of the suspension. Controlled viscosity is the characteristic parameter of the processing either for dough. A wide range of compositions are suitable for working involving the above processes of the present advancement which include binder, plasticizer, lubricant, surfactant, solvent, sintering aid etc.

Metal powders include preferably fine metal powders (~30 nm to ~400 micron size range) of transition/post-transition metals (Ti, V, Cr, Ru, Rh, Co, Ni, Mo, Zi, Al, Ta, Ru, W), lanthanides and actinides (Ce, Fe, Zr) and their alloys (like nitinol, CoCrMo, Ti6Al4V, steel etc.) are mixed with different weight percent of natural/semi-synthetic/synthetic polymers.

Polymeric binders include polymeric binders ranging from hydrophobic/hydrophilic, thermoplastic/thermosetting, wax, PVA, polyamides, nylon, polyvinyl chloride, polystyrene, polyethylene, polypropylene, polyacrylonitrile, polyvinyl butyrate, silicone, chitosan, alginate, gelatin, soy protein, whey protein, starch and derivatives, cellulose including cellulose esters and celluloids, polycaprolactone, polyolefin, polylactic acid, polyglycolic acid, their co-polymers etc.

Solvent include different solvent systems for wetting of the metal powders, partial dissolution/dispersion/lubrication of polymers and other processing aids towards homogeneous matrix formation with dispersed metal particles. Choice of solvents depends upon the hydrophobic/hydrophilic properties of the polymers and nature of the metals and their reactivity to a specific solvent. Suitable solvens include polar solvents, water, which is usually preferred owing to its environmentally friendly nature and cost-effectiveness. Besides this, aliphatic alcohols such as methanol, ethanol, propanol, isopropanol, butanol, dioxane, dimethyl formamide, dimethyl sulfoxide, N,N-dimethylacetamide, tetrahydrofuran, propylene carbonate, methyl isobutyl ketone, acid-water mixtures containing organic acids like formic acid, acetic acid, propanoic acid, inorganic acids such as hydrochloric acid, alkali/ammonical solution or any suitable noncorrosive, non-toxic solvent/co-solvent systems are useful for this process. For hydrophobic polymers, wide range of non-polar solvents are used for this process based on solubility of the polymers, like hexane, cyclohexane, toluene, carbon tetrachloride, N-vinyl pyrrolidone etc.

Lubricants that overcome stickiness and for easy removal of dough from the roll after formation, commonly involve stearic acid, stearates, sodium stearyl fumarate, sodium lauryl sulfates, oleic acid, ethylene glycol, triethylene glycol, high molecular weight polyethylene glycol, wax, paraffin, glyceryl behapate, sterotex etc.

Plasticizers include plasticizers/humectants to prevent drying of the solvents and increase the plasticity or fluidity of the blend, include glucose, sucrose, molasses, glycerol, sorbitol, glycols, sebacates, adipates, maleates, citrates (e.g., triethyl citrate, tributyl citrate etc.), benzoates, terephthalates, dibenzoates, gluterates, phthalates, azelates, trimellitates, formals, acetals etc.

Coagulants include additives such as inorganic/organic salts (e.g., nitrate, bicarbonate, chloride), polyelectrolytes (e.g., tripolyphosphate, citrate, PMMA, PAA, PMA, PEI etc.) to facilitate high viscous dough formation through coagulation, flocculation as well as gelation and thereby homogeneous distribution of the metal particles with minimized settling.

Fugitive/foaming agents include for developing porous metallic structures, usually space-holder/spacer particles ranging from polymeric fugitive particles (e.g., PVA, chitosan, styrofoam, polyurethane, camphene, naphthalene etc.), foaming agents (e.g., urea, sodium bicarbonate, ammonium bicarbonate, low melting metal powders or derivatives etc.) or soluble salts (e.g., NaCl, ammonium chloride, sugar etc.) are added during dough processing with the composition for dense fabrication. Different foaming agents involve foaming of the polymer solution through either temperature/chemical assisted foaming followed by dispersion of metal powders.

The methods under the present advancement are highly energy efficient for producing various shapes such as rods, tubes, springs, domes, sheets, sponges, biomedical implants and even miniaturized patterns/features like microrod arrays or micro gears through embossing or micro-patterning etc. as well as cellular metallic structures. Tapes produced by such process could be either laminated or pressed into bulk objects and subsequent patterning/green machining is done into various net shapes with tailorable microstructures followed by sintering under varied atmosphere. As would be apparent from the above said the method of the present advancement can be successfully utilized for forming reactive metals under controlled atmosphere as well. Compared to existing well known processes, the newly developed method of the present advancement special being economical, user friendly and time saving. This also offers high degree of homogeneity in green state and thereby sintered microstructure.

The details of the invention, its objects and advantages are explained hereunder in greater detail in relation to the following non-limiting accompanying figures and examples:

Example 1: Coagulation Dough Processing with/without Foaming

Ia: Coagulation Dough Processing (CDP) (Method 1/Scheme 1): (without Foaming)

TABLE 1

Actual composition used in coagulation dough processing for dense/and porous components

| Composition | Additive nature | Relative percent (wt) | % wrt metal | Preferred range (wt % of metal) |
|---|---|---|---|---|
| Ti6Al4V Powder | Metal powder | 80 | | |
| Polymer (e.g. egg white) | Polymer | 16 | 20.0 | 1-50 |
| Coagulant (e.g., $NH_4Cl/NH_4NO_3$/citric acid) | Coagulant | 3.2 | 4.0 | 0.1-10 |
| Other additive (e.g. sugar) | Thickener | 0.8 | 1.0 | 0.1-10 |
| Fugitive/Foaming agent | Spacer[¥] | 6 | 7.5 | 1-15 |
| Solvent (e.g., water) | Solvent | 10 | 12.5 | 3-30 |
| Total weight | | 100 | | |

[¥]Optional

Figure 1:
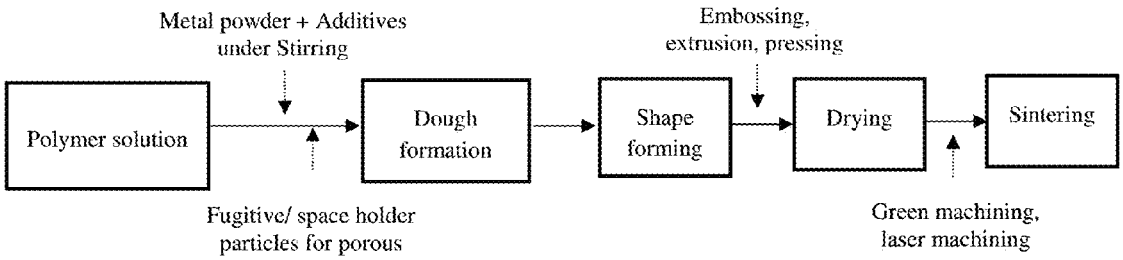
FIG. 1 represents the Method 1 of Coagulation dough processing (CDP).

Dough processing according to the Method 1 (FIG. 1) is based on the composition of Table 1. Of all the ingredients as mentioned in Table 1, measured quantities of metal powder, polymer powder, glycerol, solvents were mixed in a beaker by mechanical stirring for 10-30 minutes depending upon the volume. Viscosity of the initial mix was measured to be 100-1000 Pa·s at Shear rate 0.02 $s^{-1}$. Subsequently, coagulants were added to turn the low viscous slurry to high viscous dough. Coagulant was added with/without foaming agents with slow stirring, depending upon the porosity and subsequently the mixture was subjected to mixing through a roll mill for 2-3 hrs. till a smooth luster appeared to the dough. Roll milling facilitated preparation of homogeneous dough by removal of entrapped air bubbles and intimate mixing of all the ingredients under high shear at 100 MPas. Such mixing can also be done by mechanical stirring/sigma blender/cone blender/V-blender for bulk volumes. The above transformed the low viscous slurry to high viscous formable dough having viscosity 0.037 MPa·s. High loading of metal powder and deliberate removal of air bubble through high shear by coagulation resulted in high viscosity.

After this, the formable dough was subjected to shaping through plastic deformation/yielding above the yield stress of the prepared dough. The dried green body was further subjected to heat treatment (sintering) to obtain final dense components (FIGS. 5A and 6). Grinding, polishing or any other shaping/finishing may be done, if required.

Example 1b: With Foaming

For preparation of cellular solids, the prepared dough (as per the process described above in Example 1a,) before the roll milling step (FIG. 1), was stirred vigorously to incorporate air bubbles into the mix to attempt providing porous products. However, it was difficult to form direct foam through entrapment of air bubbles. The volume fraction of entrapped air bubbles was significantly less and highly random in nature. Overall, the process had very poor foaming ability owing to high viscosity of the mix. The resultant green body had very poor mechanical properties and relatively poor microstructural repeatability for considering it as dense or porous structures. Thus the process was excluded for any value addition.

Example 1c: Foaming Before Adding Metal Powder

To overcome the problem in Example 1b, all ingredients other than metal powder, as mentioned in Table 1, were mixed by vigorous stirring and subsequently, metal powder was slowly added under low shear mixing range from 0.1-100 $s^{-1}$. Dough obtained through this technique can be cast by gentle tapping without further roll milling into different shapes like blocks, rods, hollow structures by using different mold, dried and sintered to obtain porous structures (FIGS. 5B and 8). Sucrose or any other thickener can be optionally added to the composition to impart stability of dough. Fugitive/foaming agents can be added to the composition for interconnected secondary macropores (FIG. 5C). Components developed by this process can be utilized in various structural and functional applications such as automobile, aerospace and biomedical fields.

Example 2: Plastic Dough Processing (PDP)

TABLE 2

Actual composition used in plastic dough processing for dense/and porous components

| Composition | Additive nature | Relative percent (wt) | % wrt metal | Preferred range (wt % of metal) |
|---|---|---|---|---|
| Ti6Al4V | Metal powder | 74.2 | | |
| Chitosan | Polymer | 4.5 | 6 | 1-50 |
| Glycerol | Plasticizer | 5.0 | 6.8 | 0.1-10 |
| Stearic acid | Lubricant | 1.5 | 2 | 0.1-10 |
| Acetic acid | Solvent | 5.9 | 8 | 3-30 |
| Water | Solvent | 8.9 | 12 | 3-30 |
| Fugitive/Foaming agents | Spacer[¥] | 12.5 | ~15 | 1-15 |
| Total | | 100.0 | | |

[¥]Optional

Example 2a

Figure 2:
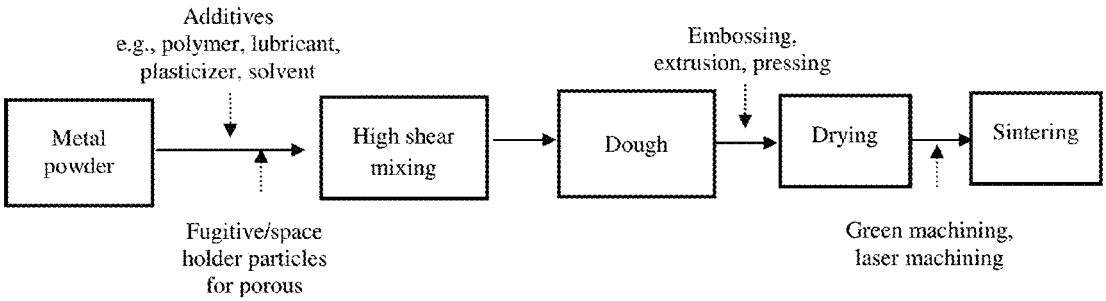
FIG. 2 represents the Method 2 of Plastic dough processing (PDP).
Figure 3:
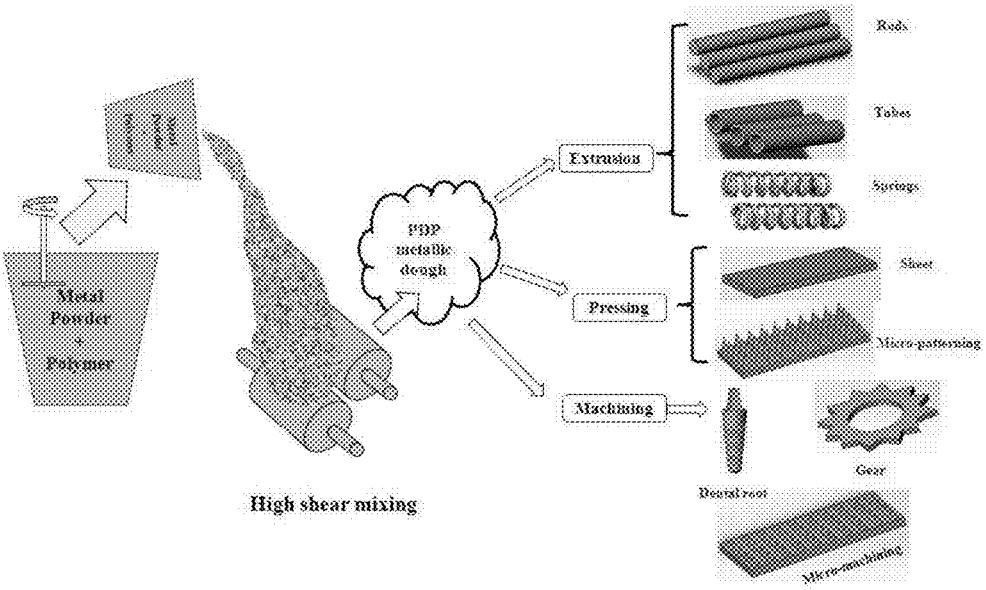
FIG. 3 represents Process sketch for Plastic Dough Processing

Dough is prepared by high shear mixing of metal powders and polymers, as described in Method 2 (FIG. 2), which is subsequently utilized for preparation of dense components. Compositions for preparation of plastic dough processing are enlisted in Table 2. Weighed quantity of metal powder was premixed with polymer powder in dry state, followed by subsequent addition of glycerol, solvents as mentioned in Table 2. These were mixed for ~10 minutes. Thereafter the mix was subjected to mixing through a roll mill for ~30 min with pressure up to 100 MPa for imparting desired high shear till a smooth luster appears to the dough with a viscosity of 27 MPas at shear rate of 0.03 $s^{-1}$. The blending was carried out up to several minutes to hours depending on nature of the compositions and their amount, under high shear mixing, with pressure up to 100 MPa preferably at low/ambient temperature to prevent drying. Temperature of rollers can be controlled by circulating hot or cold fluid. The high shear mixing can also be done by mechanical stirring/sigma blender/cone blender/V-blender for bulk volumes The dough is taken out of the roll when a smooth luster appears and stickiness disappears. Initially the dough is obtained as a sheet (FIG. 7). The thickness of the sheet can be varied as per the requirement by altering the rolls gap. The sheet can be further pressed into various shapes using mould of various shapes and sizes, The components are vacuum dried at 40-100° C. below the softening temperature of the polymers and thereafter, sintered (FIGS. 5D & E). The drying and sintering can be done under controlled atmosphere.

Very high loading of metal powder and deliberate removal of air bubble through high shear mixing results in high viscosity. The high shear mixing facilitates de-agglomeration of polymers and metal powders, promotes deformation, blending of metal powders within polymer matrix in presence of very low amount of solvent, co-solvent, plasticizer and surfactant. Additionally, this applied shear force eliminates possibility of entrapped air bubbles during formation of dense components. The low quantity of solvent enables to dry the components faster without significant deformation, warpage and surface contamination/oxidation and eventually offers processing of reactive metals even in ambient condition. The lubricants help in post processing and extrusion molding of the blend. The plastic deformation property of polymers was utilized for blending and homogenization of metal powders, lubricants etc. within polymer matrix. Dough obtained from PDP was further transformed into dense, porous, graded or laminated objects with various shapes like rods, tubes, blocks, spring or other hollow structures along with required surface texturing in a single step followed by drying and sintering (FIG. 9-13).

Example 2b

Fugitives are usually added in Method 2 during premixing stage before applying high shear if porosity is to be imparted (FIG. 5F).

Example 3 Viscosity and Porosity of Shape Forming Dough/Foam a) Rheology of Dough Rheology is an essential parameter to optimize the dough compositions for post processing, controlling microstructure—mechanical properties of the green and sintered metallic objects. Foam always have lower viscosity, where dough would exhibit very high viscosity all the time. Viscosity range for metal powder loaded foam composition vary with particle size of the powder, polymer percentage and molecular weight, solvent quantity and particle loading.

Figure 4:
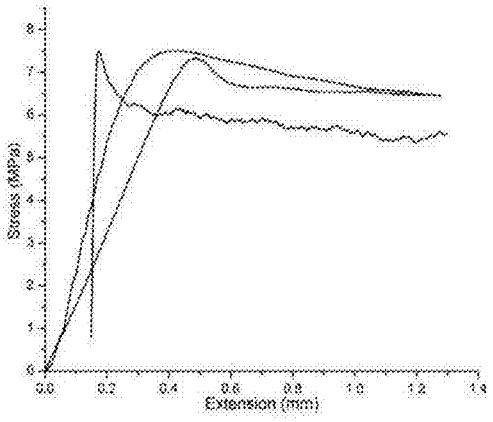
FIG. 4 represents Rheological behavior of dough containing Ti6Al4V/chitosan during extrusion.

In this context, viscosities of all prepared doughs were measured at different solvent compositions to evaluate flow behavior of the dough. To measure dough viscosity, highly viscous dough was extruded through an extruder die using universal testing machine (25K machine, Hounsfield, UK) at different cross head speed like 1.00 mm/min and respective data was analysed to evaluate viscosity of dough (FIG. 4). It is evident from the plot, the applied yield strength was comparatively less compared to the metal powder itself as well as other powder metallurgy process.

TABLE 3

Typical viscosity range for dough

| Process | Specific viscosity | Proposed range for sp. viscosity | Yield stress (MPa) | Shear rate ($s^{-1}$) |
|---|---|---|---|---|
| PDP | 26.66 MPa · s | 2 to 100 MPa · s | 2-50 | 0.03 |
| CDP | 0.037 MPa · s | 0.0001 to 1 MPa · s | 0.0001-2 | 0.03 |

b) Bulk Density, Apparent Porosity

The densities of metallic green and sintered compacts were measured by Archimedes principle in glycerol medium. Prior to the measurement of bulk density and apparent porosity, weight of the each vacuum dried samples ($w_1$) was measured in a digital weighing balance. Subsequently, they were soaked in glycerol until all the air bubbles vanished. The soaked metallic samples were suspended inside the glycerol medium for few hours. Finally, suspended soaked sample weight ($w_2$) and soaked sample weight ($w_3$) were calculated. Density the green and sintered metallic compacts were calculated by using the following formula:

$$\text{Density} = \frac{w_1 \times 1.26}{w_3 - w_2}$$

Further, the apparent porosity (%) of the compacts were calculated by using the following formula:

$$\text{Apparent porosity} = \frac{w_3 - w_1}{w_3 - w_2} \times 100$$

The density of the sintered Ti6Al4V samples obtained through PDP (example 2) was found to be achieved more than 97% and 65-70% for dense and porous components respectively.

Porosity depends upon the metal/fugitive ratio, while pore size varies depending upon the particle size of the fugitives or foaming agents. Hence, fugitives with different particle size ranging from 1-400 μm have been explored to obtain various pore diameters. Homogeneously porous objects with defined pore size or porosity graded structures were fabricated by varying the metal/fugitive ratio and particle size of the fugitives as well.

Microstructure of dense and porous samples: 1) Dense dough of Example 1a (FIG. 5A) & Example 2a (FIG. 5D-E) 2) Dough of Example 1b, Example 1c (FIGS. 5B and 5C) & Example 2b (FIG. 5F) with fugitive for porous have been explained through optical/SEM images and porosity values show that nature of porosity varied from process to process. In dough processing, pores are highly closed porous with no/very less interconnections between pores, porosity up to <50% (FIGS. 5B, 5C and 5F).

Example 5: Characteristics of Viscous Dough Produced by Example 1 and 2

The green body characteristics of the metal body obtained from Example 1a and 2a could be further varied in the final compacts based on the ratio of metal to polymer. On the other hand, physical property of the dough depended upon the rheology/viscoelastic behaviour of polymer-metal powder blend which further depend on the types and amounts of polymer, solvent used along with metal powders. Dough obtained in this process was found versatile enough to be shaped into sheets (FIG. 7), blocks, rods, tubes, spring or other hollow structures (FIG. 9-11) using extrusion moulding, followed by sintering. Lamination (FIG. 12) and surface texturing (FIGS. 10, 11 and 13) was also possible through micromachining/laser machining in the green state itself. Components developed by this process can be utilized in various structural and functional applications such as automobile, aerospace and biomedical etc.

Example 6: High Viscous Dough for Producing Metallic Alloy

High viscous dough of Example 1 and/or 2 can be utilized for in situ metal alloy formation during sintering and densification. Dough could be prepared by mixing individual metal powders to achieve desired alloy composition along with the other compositions as per examples 1 and/or 2 in single step process after sintering. For example, Ti6Al4V, Ni—Ti, Co—Cr were prepared through dough formation by powder processing as described in example 1 using Ti, Al, Ni, Co, Cr and V based powders in different required weight ratio. After sintering, final component would have the composition as per the requirement.

Example 7: Characteristics of Metal Foams

Metal foams (FIGS. 5B, 5C and 5F) produced by the Example 1b, 1c & 2b offer interesting features, both thermophysical and mechanical, such as low mass (density 5-85% of the bulk solid), large surface area (250-40,000 $m^2/m^3$), high permeability, high thermal conductivities (5-30 W/mK), resistance to thermal shocks, high pressures, high temperatures, moisture, wear and thermal cycling, good absorption of mechanical shock and sound, thus find wide applications in design/architectural, automobile, biomedical etc. Foams made of metals such as tantalum, titanium exhibit high tensile strength, corrosion resistance with excellent biocompatibility suitable for load bearing applications in humans. Porous metals, especially titanium foam, also allow vascular growth through the interconnected porous structures. Use of metallic foams in vehicles profoundly increases sound dampening, weight reduction and energy absorption during crashes or in military applications. Foam filled tubes could be used as anti-intrusion bars. Metal foams are also suitable to treat automotive exhaust gas. Compared to the traditional catalytic converter that are usually made of cordierite ceramics, metal foams of the present advancement can offer better heat transfer and excellent mass-transport properties (high turbulence); therefore, offer possibilities for using less platinum catalyst. Similar to honeycomb structures, metal foams are also being used for stiffening a structure without significant increase in mass. Metal foams, for this type of application essentially have closed porous structures.

Example 8: Gradient Porous Structures

Metallic components are subjected to fail under dynamic/static load due to stress accumulation inside the components causing the stress shielding effect. Gradient porous structures are required to transmit the load and minimize this effect. Therefore, a method was developed to fabricate gradient porous structures. Dough with different percentage of fugitive contents was prepared as per example 1 and/or 2 and further processed via shape forming to develop green bodies with variable porosity. These green shapes were joined one after another to fabricate porous or dense-porous gradient structures. Layers can be joined by many techniques such as lamination, solvent spraying and pasting etc. Gradient porosity of each component was measured using quantitative analysis of the cross-section.

Components developed by this process have different type of porous architecture with variable porosity. These components are used for various structural and functional applications including heat sink, heat exchanger, aerospace, biomedical industries etc. Modulus of materials is tailored by making it porous and sandwich structure to mimic cancellous bone architecture.

Example 9: Extrusion of Viscous Dough

For symmetrical objects like rods, tubes etc., extrusion molding of the dough obtained from examples 1 and 2 was carried out for shape forming in single step under universal testing machine using extrusion die at variable compressive force. Different types of extrusion molds were designed as per requirement as well as flowability of the dough. Prior to extrusion, a rolled sheet obtained via example 1 and/or 2 was used to minimize air entrapment and inserted into the mold. Depending on rheological properties of the dough, cross head speed was set to execute smooth and continuous extrusion. The extruded tubes, cylindrical or rectangular, hexagonal rods, disks, rings were further subjected to laser/CNC machining for the fabrication of diverse shapes such as spring, screw, implants and other medical device applications.

The variable diameter tubes, rods, springs (FIG. 9-11) could be manufactured by the combinatorial approaches mentioned above for diverse biomedical applications like bare metal stent, drug eluting stent, device for lumen structure, dental arch wires, bone plates, bone screws, dental roots and crowns, dental bridges, spinal shunt etc. in a cost-effective way. Broadly, these products can be utilized in several structural and functional applications.

Example 10: CNC Machining

Products developed in example 1-9 were further reshaped into various forms through net shape forming via CNC machining. A desktop 4-axis CNC machine (MODELA pro, MDX-540) was used to perform green machining. Machining was carried out in two modes, stationary and rotary. Prior to machining, 'stl' format of model was selected to fabricate physical model from a green body. Different types of tools were selected to execute green machining as per the 3D design. Based on the mechanical properties and green density of the compacts, the machining parameters like depth of cut, rpm, rate of movement of tool and distance between tool paths were optimized during surfacing/roughing. This way, rods developed in example 9 were mounted on CNC and further machined into dental roots (FIG. 10). The machined products were either dense or porous for diverse structural and functional application likewise earlier methods.

Example 11: Laser Machining

Different components for structural applications as developed in example 1-10 were further transformed into various shapes with the help of laser machining in green state. Prior to laser machining, a drawing of pattern/shape was sketched in Corel DRAW software. A 2 axis laser machine (VLS 2.30, Universal Laser System, UK) with $CO_2$ laser power of 30 W was used to perform cutting and rasting. Machining surface was focused by adjusting the z-axis. 2D file of drawn pattern was imported into software used for machining. Software controlled laser beam intensity, scanning rate, depth of engraving, mode of machining (stationary/rotary) etc. Optimized machining parameters were set to perform laser machining. A flat green metallic sheet was used for stationary machining, while extruded tubes/rods were used for rotary machining. Micromachining using laser was performed to generate micro/macro roughness on the surface of the developed components. Further, laser cutting was performed to develop shapes like metallic springs, porous architectures, surface texturing etc. (FIG. 11).

Components developed in this way can have features from ~50 nm to meters. Products such as springs, micro gears etc find use in aerospace industries at elevated temperature. Surface texturing generated by this technique in nano to millimeter range is used for biomedical applications to improve tissue adhesion.

Example 12: Porous Shapes Combined with Laser Machining and Lamination

Different type of porous architecture was developed through machining and lamination approach. The laser machine (VLS 2.30, Universal Laser System, UK) was used with optimized machining parameters to execute machining. A 2D design for individual tape was sketched in CorelDRAW software. Prior to machining, parameters like laser beam intensity, scanning rate, depth of engraving were optimized. A green tape/sheet developed by viscous dough obtained from example 1 and/or 2, respectively was used to create different shapes and cuts through laser machining. Further, these sheets were joined through lamination for developing different internal porous architectures (FIG. 12). Products developed by this process may have control larger pore size compared to previous examples. These components can also be used in diverse structural and functional applications.

Example 13: Macro and Micro-Patterning Through Embossing

In example 12, micro-patterned surface/texture was developed via laser machining. However, embossing could be an alternate route to laser machining for developing surface textures/roughness with varied dimension from ~5 micron to millimeters range. Prior to embossing, master molds of PMMA/metal/silicone were developed by laser/CNC machining and coated with petroleum jelly for easy removal of the patterned sheet. Tape developed in example 1 and/or 2 was used for generating surface architecture such as micro channels, micro gears, micro arrays etc (FIG. 13). Tape was pressed against master pattern mold and load was applied using universal testing machine (25K machine, Hounsfield, UK) to emboss over the sheet. The master pattern can be removed physically or through burning. These products can also be used in biomedical industries for improved tissue adhesion and morphological fixation.

Example 14: Properties of Dough a) TGA Analysis

Thermo-gravimetric analysis (TGA) of the green samples is carried out to know the binder burn out temperature. Dough obtained from Ti6Al4V-chitosan system of (Examples 1 and 2) was analyzed for TGA by Thermo-gravimetric analyzer (Perkin Elmer Pyris Diamond Model, MA) using alumina crucible under argon atmosphere in the temperature range of 50 to 1000° C. with a heating rate of 10° C./min. It was revealed that binder burn out starts at ~250° C. and almost completed at ~450° C. (FIG. 14). The sintering schedule was set according to this data for binder burn out.

b) Particle Distribution

Particle distributions throughout the dough were evaluated under the microscope. Prior to the characterization, samples were completely dried under vacuum at 60° C. Topography of green and sintered samples was studied by sputter coating with gold (Polaron, UK) and observed under SEM (EVO 60, Carl Zeiss SMT, Germany). Samples were also analysed under energy-dispersive X-ray spectroscopy (EDX) to observe oxide formation on the surface. The particles were found uniformly distributed throughout the polymer matrix without significant voids/defects. The particle-particle contacts were sufficient for sintering at 1400° C. for Ti and its alloy using average particle size ($d_{50}$) 40 micron (FIG. 15). The sintered dense samples showed minimum defects within the samples as shown in Micro-CT images and SEM microscopic images (FIG. 15). There was insignificant surface oxide formation as confirmed by the EDX analysis (FIG. 15). Thus, the process exhibits overall superiority over the conventional processes.

c) Hardness

Micro-hardness measurements of green compacts were carried out using a Vickers diamond indenter (UHL-VMHT, Germany) operated at a load of 5 gram force with an indentation dwell time of 10 s. Further, for measurement of micro-hardness of the sintered samples, LECO Hardness Tester (LV 700, LECO Corporation, USA) was used under 1000 kilogram force load with 10 s dwell time. Prior to hardness measurement, all the samples were polished to focus under optical microscope. At least ten indentations were taken at different positions of the samples for each specimen and the average values were reported.

d) Mechanical-Strength

The strength of a material in Example 2a is measured in terms of either the stress necessary to cause appreciable plastic deformation or the maximum stress that the material can withstand. Prior to mechanical testing, a tapes and bars with variable thickness were produced by PDP process. Further, they were cut into testing samples according to ASTM standard by laser machining and punching (FIG. 16).

The flexural strength and compressive strength of both green and sintered samples were measured by using universal testing machine (25K machine, Hounsfield, UK) at cross head speed of 0.5-1.0 mm/min using 5000 N load cell (FIG. 16). At least ten tests of each sample were performed and average was reported as final value. The flexural strength for green sample of Ti6Al4V in Example 2a was found ~2.8 MPa.

The embodiments of the present invention thus relate to a novel approach to form dense and/or porous metallic bodies with various sizes and shapes for biomedical and structural applications with tailorable porosity, pore-size distribution, pore-volume and microstructure. The processing of polymer metal blend composition at ambient condition with controlled viscosity is highly energy efficient for producing various shapes such as rods, tubes, springs, domes, sheets, sponges, biomedical implants.

While the present invention has been particularly shown and described with reference to embodiments thereof, it will be understood by those of ordinary skill in the art that various changes in form and details may be made therein without departing from the spirit and scope of the present invention as defined by the following claims.

We claim:

1. A process of dough forming of polymer-metal blend compositions with increased viscosity suitable for shape forming comprising:

i) providing polymeric solution and coagulant with or without other additives to provide a polymer-coagulant composition;

ii) subjecting said polymer-coagulant composition to vigorous stirring to increase viscosity by frothing thereby incorporating air bubbles into said polymer-coagulant composition to obtain a porous polymer-coagulant composition; and iii) thereafter gradually adding the metal powder to said porous polymer-coagulant composition of step ii) above to thereby further increase of viscosity of said metal powder dispersion in porous polymer-coagulant composition and generate a porous shape formable dough under ambient condition with improved viscosity.

2. The process as claimed in claim 1, wherein the process is carried out with or without foaming agents or fugitives.

3. The process as claimed in claim 1, comprising:

increasing the viscosity of said metal powder dispersion in polymer-coagulant composition with or without other additives to thereby provide for said dense shape formable dough via high shear mixing with pressure ranging from 1 to 500 MPa preferably upto 100 MPa; and subjecting the thus obtained dense shape formable dough to shape forming, drying and sintering.

4. The process as claimed in claim 3, wherein the step of stirring is carried out selectively involving anyone or more of roll mill, mechanical stirring/sigma blender/cone blender/V-blender for bulk volumes and after mixing subjecting the dough to shaping through plastic deformation/yielding above the yield stress of the prepared dough, and finally the dried green body further subjected to heat treatment (sintering) to obtain final dense components optionally involving grinding, polishing or any other shaping/finishing.

5. The process as claimed in claim 4, wherein the polymer-blend composition (wt %) comprises based on the weight of metal powder:

| | |
|---|---|
| A) Polymer powder | 1-50 |
| B) Solvent | 3-30 |
| C) Lubricants | 0.1-10 |
| D) Plasticizers | 0.1-10 |
| E) Coagulant | 0.1-10 |
| F) Other additives | 0.1-10. |

6. The process as claimed in claim 1, involving porous shape formable dough comprising:

i) subjecting the thus obtained porous shape formable dough to cast into a predefined lubricated mold for shape forming without further high shear mixing, and drying; and ii) dried green body being further subjected to heat treatment (sintering) to obtain final porous components.

7. The process as claimed in claim 1, comprising addition of foaming agents and/or fugitive particles for porosity or increasing pore connectivity in said generated shape formable dough for porous structures, interconnected secondary macropores and wherein sintered density, total porosity, pore size distribution, microstructure, mechanical properties are selectively varied based on selective additives involved.

8. The process as claimed in claim 7, wherein the polymer-blend composition (wt %) comprises based on the weight of the metal powder:

| | |
|---|---|
| A) Polymer powder | 1-50 |
| B) Solvent | 3-30 |
| C) Lubricants | 0.1-10 |
| D) Plasticizers | 0.1-10 |
| E) Coagulant | 0.1-10 |
| F) Other additives | 0.1-10 |
| G) Fugitive/foaming agent | upto 15. |

9. The process as claimed in claim 1, wherein the low viscous polymer-metal blend composition is converted into high viscous dough under ambient conditions to generate shape formable dough with the following specifications:

For coagulation dough processing:

Viscosity at shear rate 0.03 ($s^{-1}$): 0.0001 to 1 MPa·s

Yield stress (MPa): 0.0001-2.

10. A process of dough forming of polymer-metal blend compositions with increased viscosity suitable for shape forming comprising:

i) providing metal powder;

ii) adding said metal powder to polymer with or without additives to obtain a polymer-metal blend composition; and iii) subjecting the said metal polymer-metal blend composition to high shear mixing involving plastic dough processing to thereby generate shape formable plastic dough.

11. The process as claimed in claim 10, wherein the high shear mixing is carried out with pressure range of 1 to 500 MPa, preferably upto 100 MPa, at low temperature 4° C. to 40° C., preferably at 10° C., for de-agglomeration of polymers and metal powders and wherein the high shear promotes deformation, blending of metal powders within polymer matrix in presence of very low amount of solvent, co-solvent, plasticizer and surfactant along with the applied shear force eliminating possibility of entrapped air bubbles during formation of dense components.

12. The process as claimed in claim 10, wherein (a) for dense component dough forming composition by weight of metal powder comprises:

| | |
|---|---|
| A) Polymer Powder | 1-50 |
| B) Solvent | 3-30 |
| C) Lubricants | 0.1-10 |
| D) Plasticizers | 0.1-10. |

and (b) for porous components dough forming composition by weight of metal powder comprises:

| | |
|---|---|
| A) Polymer Powder | 1-50 |
| B) Solvent | 3-30 |
| C) Lubricants | 0.1-10 |
| D) Plasticizers | 0.1-10 |
| F) Fugitive/foaming agent | 1-15. |

13. The process as claimed in claim 12, wherein after the formation of the shape formable dough, the additive/foaming agents are removed by anyone or more of:

(i) formed dough is either heated at 100-600° C. for burning out of the organic/inorganic fugitive particles; or (ii) dipping within a solvent for leaching out of the soluble polymer/inorganic salts which leaves spaces after removal and turned into foam after sintering.

14. The process as claimed in claim 10, wherein the low viscous polymer-metal blend composition is converted into high viscous dough under ambient conditions to generate shape formable dough with the following specifications:

for plastic dough processing involving high shear mixing of metal powder and polymer blend composition:

viscosity at shear rate 0.03 ($s^{-1}$): 2 to 100 MPa·s yield stress (MPa): 2-50.

15. The process as claimed in claim 14, wherein the dough obtained is selectively worked into dense and/or porous, graded or laminated objects with various shapes including rods, tubes, blocks, spring or other hollow structures along with required surface texturing for metal stent, drug eluting stent, device for lumen stricture, bone plates, bone screws, dental roots and crowns, dental bridges, spinal shunt, hip joints, knee joints and any other structural load bearing supports, metal foams for architectural, automobile, bio-medical applications including cancellous bone analogue, dense-porous laminates and gradients for dental roots and bone.

* * * * *